United States Patent [19]

Schmidt

[11] Patent Number: 4,649,796

[45] Date of Patent: Mar. 17, 1987

[54] METHOD AND APPARATUS FOR SETTING A PROJECTILE FUZE DURING MUZZLE EXIT

[75] Inventor: Jimmy Q. Schmidt, Baltimore, Md.

[73] Assignee: The United States of America as represented by the Secretary of the Army, Washington, D.C.

[21] Appl. No.: 875,843

[22] Filed: Jun. 18, 1986

[51] Int. Cl.[4] ..... F42C 17/00; G01D 3/66

[52] U.S. Cl. ..... 89/6.5; 73/167; 324/179

[58] Field of Search ..... 89/6.5; 73/167; 324/179, 178; 102/209

[56] References Cited

U.S. PATENT DOCUMENTS

| | | | |
|---|---|---|---|
| 1,739,921 | 12/1929 | Schuler et al. | 89/6.5 X |
| 2,465,351 | 3/1949 | Busignies et al. | 89/6.5 X |
| 2,555,384 | 6/1951 | Watt | 89/6.5 X |
| 2,557,949 | 6/1951 | Deloraine | 89/6.5 X |
| 3,958,510 | 5/1976 | Stutzle | 89/6.5 X |
| 4,022,102 | 5/1977 | Ettel | 89/6.5 |
| 4,142,442 | 3/1979 | Tuten | 89/6.5 |
| 4,228,397 | 10/1980 | Schmidt | 324/179 |
| 4,283,989 | 8/1981 | Toulios et al. | 89/6.5 |
| 4,486,710 | 12/1984 | Schmidt | 324/179 |
| 4,524,323 | 6/1985 | Schmidt | 324/179 |

FOREIGN PATENT DOCUMENTS

| | | | |
|---|---|---|---|
| 3307785 | 9/1984 | Fed. Rep. of Germany | 89/6.5 |

OTHER PUBLICATIONS

General Electric Co., Armament and Electrical Systems Dept., Burlington, VT, "Autoset Fuzing System Study", 81APB530, Jul. 1981, Post—launch, In—bore, Inductive Autoset Fuzing Systems, pp. 6–5, 6–7, 8–27 to 8–33, 8–46, and 8–48/8–49.

Danner, "Inductive Remote Set for Tank Application, Status, Phase I 6.2 Program", May, 1979, Harry Diamond Laboratories, Adelphi, MD.

Danner, "Inductive Remote Set", Development FY 79, 5 Oct. 1979, Harry Diamond Laboratories, Adelphi, MD.

*Primary Examiner*—David H. Brown

*Attorney, Agent, or Firm*—Saul Elbaum; Tom McDonald; Alan J. Kennedy

[57] ABSTRACT

A method and apparatus for setting a time delay value in an electronic fuze of a projectile exiting the muzzle of a gun barrel, in which a single transmitter coil concentrically mounted to the gun muzzle is utilized both to sense the presence of the projectile at the gun muzzle and to inductively transmit a radio frequency signal having a duration proportional to the fuze time delay value to a receiver coil disposed on the projectile. The transmitter coil is energized from a radio frequency oscillator before the projectile is fired. As the front end of the projectile begins to emerge from the gun muzzle, its presence is detected by a change in the transmitter coil impedance, and the transmitter coil is automatically deenergized. The receiver coil is spaced from the front end of the projectile so that it is not inductively coupled to the transmitter coil, the transmitter coil is reenergized from the oscillator for a time period proportional to the fuze time delay value to be set, then again deenergized until the projectile has completely emerged from the gun muzzle. The signal received by the receiver coil is processed by circuitry within the projectile to set the fuze time delay value.

6 Claims, 5 Drawing Figures

METHOD AND APPARATUS FOR SETTING A PROJECTILE FUZE DURING MUZZLE EXIT

RIGHTS OF THE GOVERNMENT

The invention described herein may be manufactured, used, and licensed by or for the Government for Governmental purposes without the payment to me of any royalties thereon.

BACKGROUND OF THE INVENTION

The invention relates generally to a method and apparatus for setting a time delay in a projectile fuze. More particularly, the invention relates to a method and apparatus for automatically setting a time delay in a digital type projectile fuze during the exit of the projectile from a gun barrel, wherein the time delay data is inductively transmitted from a transmitter secured to the barrel muzzle to a receiver located in the projectile.

The advent of terrain guidance missiles or low flying cruise type missiles has facilitated undetected penetration of outer defenses and greatly decreased the time between detection and target impact. Fast countermeasure response is also necessary under battle conditions such as an enemy helicopter rising from behind cover, sighting, firing, and descending behind cover before an air defense gun can respond properly and fire. Since these type threats can be considered "soft armored", the best countermeasure is often a high explosively fragmented projectile. The time response to these types of threats is so small that presetting a fuze prior to firing is impractical. Proximity type fuzes, which can be used for a fast response gun system, suffer in accuracy due to signal multi-path returns on low trajectory projectiles, especially when encountering targets over water.

U.S. Pat. No. 3,958,510, issued May 25, 1976 to Stutzle, describes a system for setting the fuze of a projectile as it leaves the muzzle of a gun by adjusting the magnitude of a magnetic field through which the projectile is passing. This system includes a control coil mounted on the muzzle of the gun barrel and a receiver coil mounted in the projectile. The amplitude of the induced current in the receiver coil which is generated during passage of the projectile through the control coil and which is used to set the fuze, is adjusted by adjusting the amplitude of a direct current supplied to the control coil. In this system, the amplitude of the induced voltage and receiver coil during passage through the control coil is dependent not only on the projectile velocity but also on the centering of the projectile within the control coil.

U.S. Pat. No. 4,142,442, issued Mar. 6, 1979 to Tuten, describes a system in which the time setting of the fuze of an artillery shell is digitally set after the shell has been fired but before it leaves the muzzle of the gun. The communications link for setting the fuze includes a transmitting coil mounted on the gun muzzle and a receiving coil mounted on the artillery shell. The transmitting coil is energized with a plurality of signals at discrete frequencies. The output from the receiving coil is detected to derive one binary digit representing each discrete frequency. All of the binary digits are simultaneously set into a binary counter in the fuze, so that the binary number represents the time delay setting for the fuze. This system requires a plurality of constant frequency oscillators in the transmitter, as well as a like plurality of filters tuned respectively to the frequencies of outputs of the oscillators.

U.S. Pat. No. 4,022,102, issued May 10, 1977 to Ettel, describes a much simpler system for adjusting a projectile fuze after firing a projectile out of a gun barrel, wherein information is transmitted inductively from a transmitter mounted in front of the gun barrel to a receiver located in the projectile. The passage of the projectile through a trigger coil mounted adjacent the barrel muzzle triggers the transmission of pertinent information and after such passage, information is computed and stored. Upon passage of the projectile through a transmitter coil disposed in front of and spaced from the trigger coil, the information is transmitted from the transmitter coil in the form of pulses to the receiver coil. The length of the transmitter coil and the frequency of the pulses are chosen so that all information can be transmitted during the time that the receiver coil is inductively coupled with the transmitter coil. These two spaced-apart coils mounted to the gun barrel are more difficult to shield against countermeasures signals and to protect against erosion by propellant gases than a single coil of very short length, such as described in my U.S. Pat. Nos. 4,228,397 and 4,486,710. Also, these two spaced-apart coils present a conspicuous target to enemy gun fire.

SUMMARY OF THE INVENTION

Therefore, it is a primary object of the invention to provide a method and apparatus for setting a time delay value in an electronic fuze of a projectile exiting the muzzle of a gun barrel, in which a single transmitter coil mounted to the gun muzzle is utilized both to sense the projectile and to inductively transmit a radio frequency signal having a duration proportional to the fuze time delay value to a receiver coil disposed in the projectile during the time period in which the transmitter and receiver coils are inductively coupled.

It is a further object of the invention to provide such a method and apparatus in which the input communications circuitry disposed in the projectile is disabled immediately after muzzle exit.

It is another object of the invention to provide such a method and apparatus in which the transmitter coil is effectively shielded against any electronic countermeasure signals.

It is a still further object of the invention to provide such a method and apparatus in which the transmitter coil is designed and constructed to minimize erosion of the coil by propellant gases expelled from the gun barrel.

In the method and apparatus described herein, a transmitter coil mounted on the gun muzzle is energized from a radio frequency oscillator before the projectile is fired. As the projectile begins to emerge from the muzzle of the gun, its presence is detected by a change in the impedance in the transmitter coil. The presence of the projectile at the muzzle automatically switches the oscillator to a wait period while the projectile passes through the muzzle-mounted transmitter coil until the receiving antenna on the projectile is aligned with the transmitter coil. At this time, the oscillator is turned back on in a data communicating mode. Calculated time of flight (TOF) data from a fire control system is then transmitted to the projectile in a pulse packet mode. This TOF data is coupled into a digital time delay circuit in the projectile which translates the received signal into the actual time delay required to detonate the projectile at target engagement. Also, electronic circuitry in the projectile automatically disables the input circuitry to the projectile immediately after completion of the data transfer to eliminate any possibility of enemy electronic countermeasures.

BRIEF DESCRIPTION OF THE DRAWINGS

The invention will be better understood, and further objects, features and advantages thereof will become more apparent from the following description of the preferred embodiment, taken in conjunction with the accompanying drawings in which.

DETAILED DESCRIPTION OF THE PREFERRED EMBODIMENT

Figure 1:
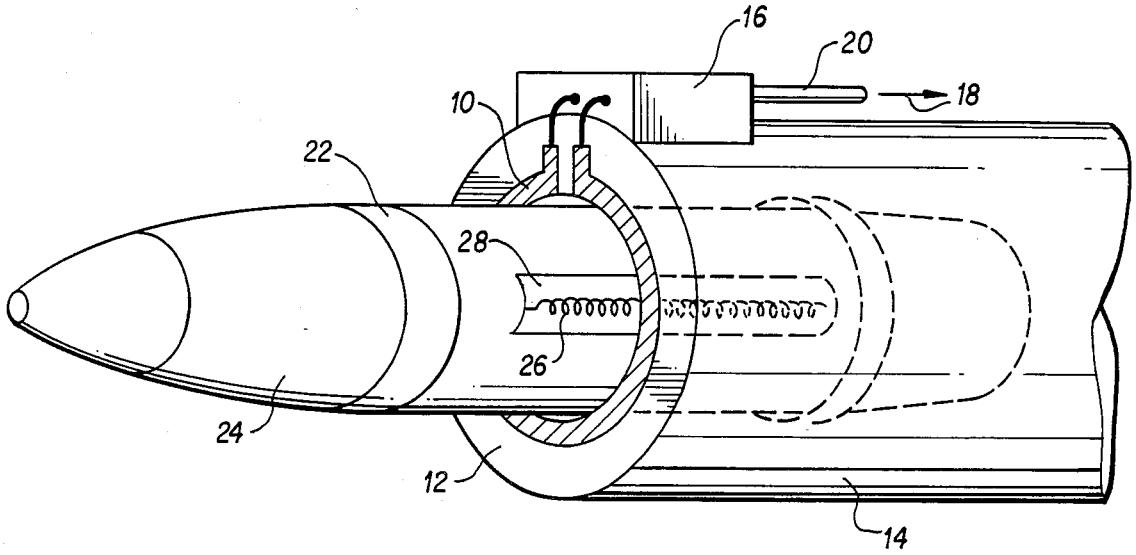
FIG. 1 is a view, in perspective, of a projectile exiting a gun muzzle through a radio frequency transmitter coil, according to the invention.

The basic mechanics of the data transmission method is shown in FIG. 1. A transmitter coil 10, which also serves as a sensor loop, is rigidly attached to the muzzle face 12 of a gun tube 14. The transmitter coil 10 is held in place by a mounting collar of electrially-conductive material, not shown in this figure for clarity. The mounting collar may be screwed onto the gun, clamped to the gun, or bolted to the muzzle face depending on the gun configuration. For example, this mounting collar may be similar to that described in my U.S. Pat. No. 4,228,397, incorporated herein by reference, in which a conductive tube member disposed about the end of the gun muzzle has an inwardly projecting shoulder which extends over and shields the coil 10. This mounting flange limits the RF radiation from the transmitter coil 10, to minimize detection of this field by enemy observers. Also, the mounting collar shields the transmitter coil 10 against enemy countermeasure signals.

The transmitter coil 10 is configured to have a narrow width, to minimize the area of the coil exposed to the severe environment at the muzzle end of the gun barrel 14. For example, if more than a single turn is utilized in this transmitter coil 10, the coil can be wound as a "pancake" coil to maintain minimum thickness. Preferably, the transmitter coil 10 is a ceramic coated coil, similar to that described in my U.S. Pat. No. 4,524,323, which is incorporated herein by reference. The use of such a ceramic coated coil greatly reduces the rate of erosion of the inner loop of the coil when it is attached to the muzzle face of the gun barrel 14.

The transmitter coil 10 and a tuning capacitor 16, which is connected across the transmitter coil 10 and which is mounted in the collar or in a small box attached to the collar, is connected to an RF oscillator 18 by a cable 20. When excited by the oscillator 18, the transmitter coil 10 radiates an electromagnetic field into the bore area of the gun barrel 14. As the bourrelet 22 of a projectile 24 passes the transmitter coil 10, interaction between the projectile 24 and the electromagnetic field causes an impedance change in the oscillator signal which, when electronically processed, indicates the presence of the projectile 24 at the transmitter coil 10. Through the use of electronic circuitry and electronic time delays, the oscillator signal is disconnected from the transmitter coil 10 for a predetermined time based on the projectile dimensions and projectile muzzle velocity. During this time the projectile continues to emerge from the gun barrel 14.

After a period of time, sufficient to allow a section of the projectile containing a receiver coil 26 to slightly pass the transmitter coil 10, the time of flight data is inductively transmitted to the projectile 24 via the receiving coil 26 which is insulated from the metallic part of the projectile 24. This is done by turning the oscillator 18 back on in a short burst, the time duration of which is determined by the time of flight desired. The burst of data transmitted to the projectile 24 is then coupled to signal processing circuitry within the projectile 24.

In FIG. 1, the receiver coil 26 is shown as a relatively small coil extending along one side of the projectile 24 which is insulated from the projectile by a layer 28 of insulating material. For optimum inductive coupling of the transmitter and receiver coils, the receiver coil 26 could be formed as a coil of insulated conductive tape or wire extending completely about the main body of the projectile 24. However, such a large receiver coil would be very subject to mechanical damage during firing. Conversely, if the receiver coil were formed as a rigid receiver bus extending along one side of the projectile 24, it could be more easily protected against mechanical damage during firing but would have minimal inductive coupling with the transmitter coil, thus requiring more stages of amplification in the signal processing circuitry of the projectile 24. The particular configuration shown in FIG. 1 for the receiver coil 26 represents a compromise between the desired electrical and mechanical characteristics of this coil.

Figure 2:
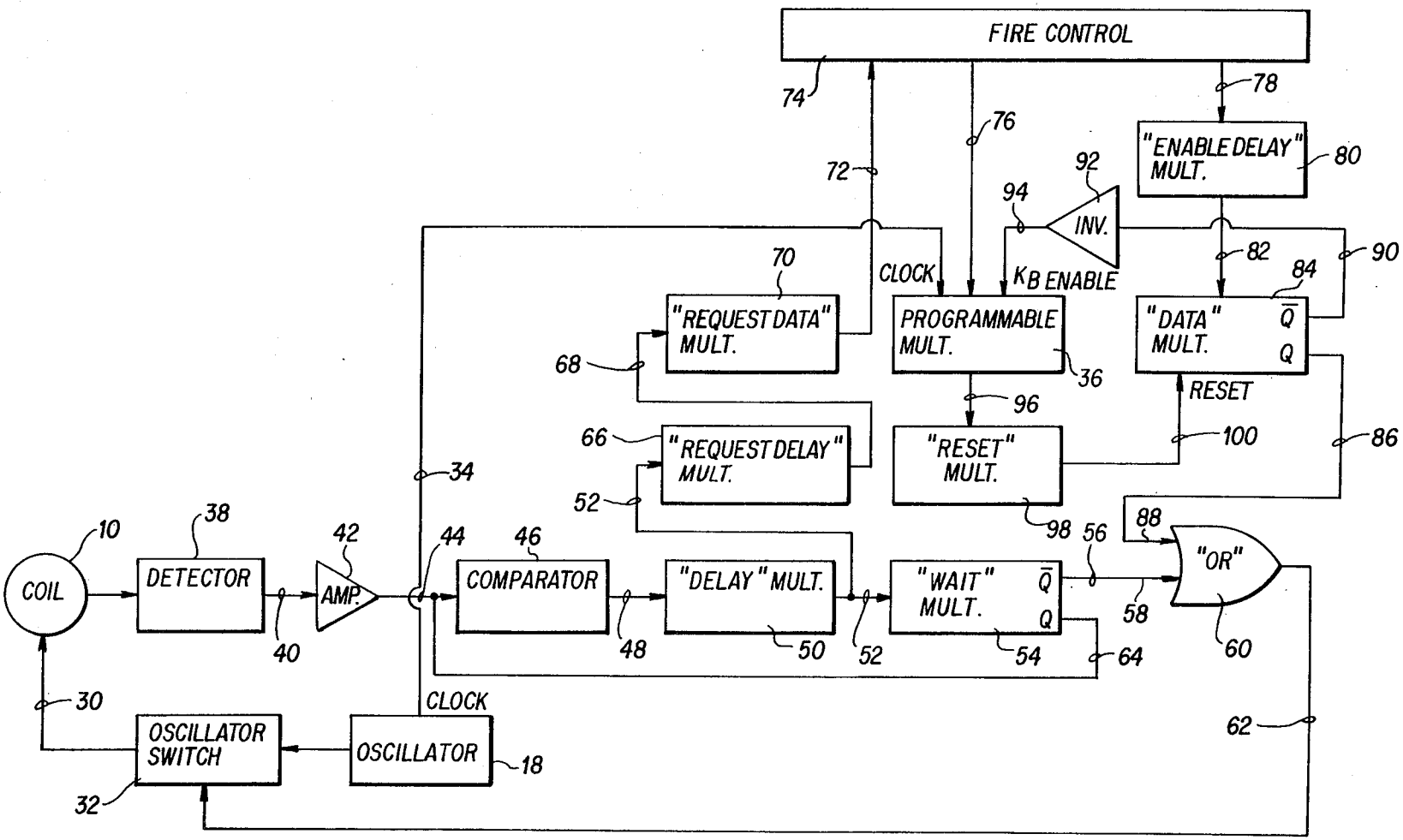
FIG. 2 is a block diagram of the projectile sensing and data transmitting circuitry, according to the invention.
Figure 3:
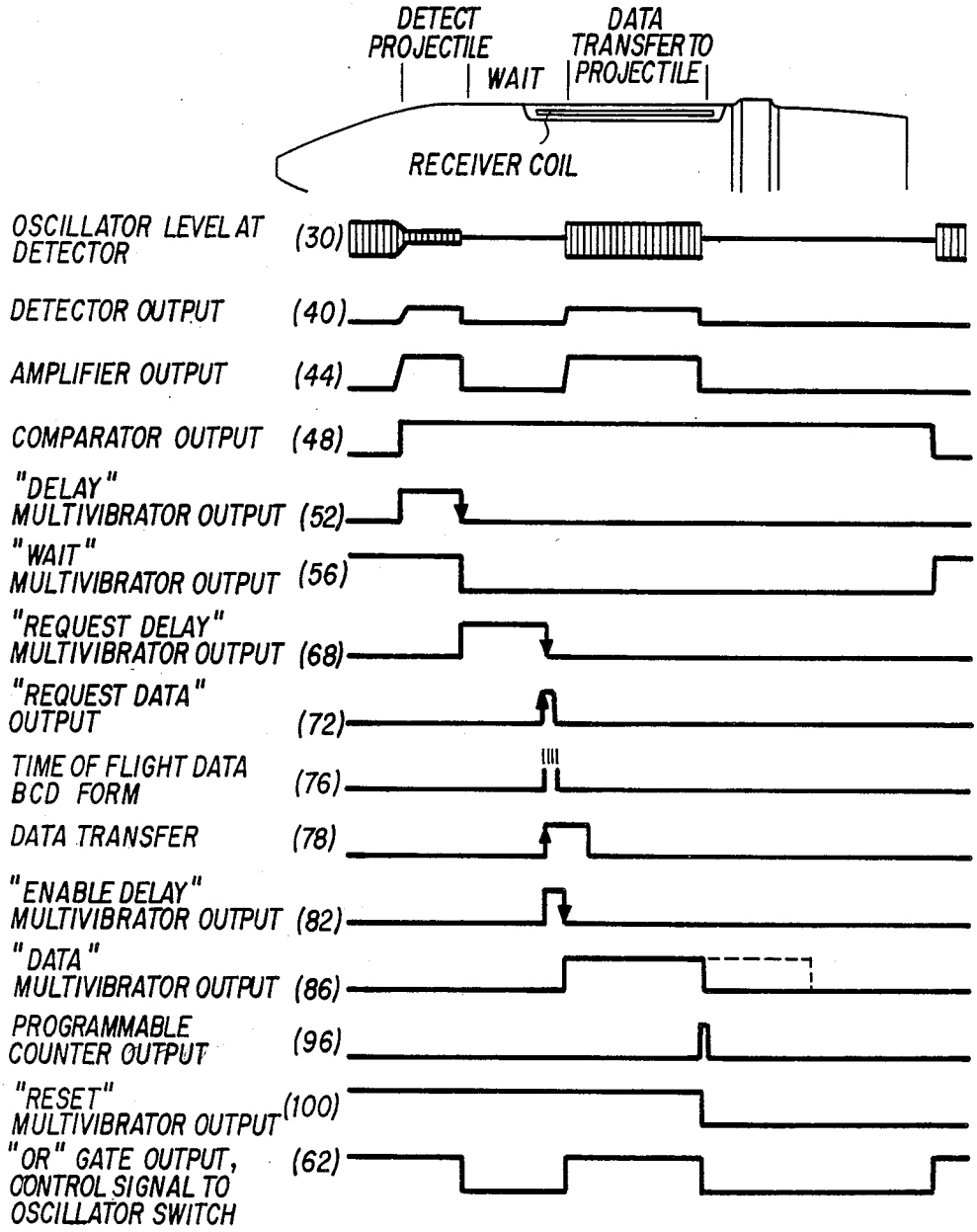
FIG. 3 is a plot of amplitude versus time for various signals in the sensor and transmitter circuits, during the time that the projectile is exiting the gun muzzle.

The block diagram of the electronic circuitry for sensing the presence of a projectile 24 at the gun muzzle and for transmitting the required data to the projectile 24 are shown in FIG. 2, and the associated timing waveforms are shown in FIG. 3.

When a projectile 24 is fired through the gun barrel 14, the crystal controlled oscillator 18 is normally oscillating and providing a 10 MHz output signal 30 through an electronic switching circuit 32 to the transmitter coil 10. A Connor-Winfield Corp. amplifier, Model S14R2, may be used for the oscillator 18, and an RCA integrated circuit switch CD-4066 may be used for the oscillator switch 32. A 10 MHz frequency is used here for purposes of explaining the circuit operation. However, other frequencies can be used, as will be explained later. The oscillator 18 also provides a 10 MHz clock signal 34 to a programmable counter 36, such as an RCA counter CD-4059.

The 10 MHz signal 30 to the transmitter coil 10 excites the transmitter coil 10, providing a means of detecting the presence of the projectile 24 at the gun muzzle 12. As the presence of the projectile 24 interacts with the radiated field of the transmitter coil 10, the amplitude of the oscillator signal 30 across the transmitter coil 10 is modulated. The oscillator signal 30 is amplitude detected by a conventional diode detector 38, which provides a positive going output signal 40 to the input of an amplifier 42, such as a Harris HA-2625 amplifier. The amplified signal 44 is feed to voltage comparator 46, for example, a Motorola MC-1710, which provides a transistor-transistor logic (TTL) pulse 48 to a "DELAY" multivibrator 50, causing the "DELAY" multivibrator 50 to generate a positive output pulse 52 for a preset delay time. The negative-going trailing edge of the output signal 52 of the "DELAY" multivibrator 50 triggers a "WAIT" multivibrator 54.

The "WAIT" multivibrator 54 has a Q output which normally supplies a positive output signal 56 to one input 58 of an "OR" gate 60, such as one gate of an RCA CD-4001 gate assembly. In turn, the "OR" gate 60 supplies a positive output signal 62 to the oscillator switch 32 to maintain the oscillator switch 32 closed. When the "WAIT" multivibrator 54 is triggered by the negative-going edge of the "DELAY" multivibrator output signal 52, the Q output of the "WAIT" multivibrator 54 is opened and the Q output signal 56 drops to zero for a preset period of time. When the Q output signal 56 drops to zero, the output signal 62 of the "OR" gate also drops to zero, causing the oscillator switch 32 to open.

The "WAIT" multivibrator 54 also has a normally open Q output connected to the input of the comparator 46. When the "WAIT" multivibrator 54 is triggered by the negative-going edge of the "DELAY" multivibrator output signal 52, a positive output signal 64 is generated at the Q output for the same predetermined period of time as the Q output is opened. This positive output signal 64 is fed back to the input of the comparator 46 as positive feedback to hold the comparator output high when the oscillator signal 30 is switched off. The delay introduced by the "DELAY" multivibrator 50 is necessary to prevent the circuitry from trying to cut off the oscillator signal 30 at the precise instant the presence of the projectile 24 is being detected.

The negative-going trailing edge of the output signal 52 of the "DELAY" multivibrator 50 is also used to trigger a "REQUEST DELAY" multivibrator 66, which generates a positive output signal 68 for a predetermined time delay period. The time delay provided by the "REQUEST DELAY" multivibrator 66 is such as to allow the receiver coil 26 on the projectile 24 to slightly pass the transmitter coil 10. This time delay is based on the projectile dimensions, the muzzle velocity and the normal variations in velocity to ensure that the receiver coil 26 is in proper position to receive the data transmitted from the transmitter coil 10.

The trailing edge of the output signal 68 of the "REQUEST DELAY" multivibrator 66 triggers a "REQUEST DATA" multivibrator 70, which generates a positive output pulse 72. The leading edge of the "REQUEST DATA" multivibrator output signal 72 is used to request data transfer from a fire control system 74.

The fire control system 74, which is not part of the present invention, can be a radar tracking system or laser range finder system which tracks a target and provides an estimate of the time of flight of the time of the projectile to the predicted target position.

In response to the data request signal 72, the fire control system 74 provides an estimated time of flight signal 76 in binary-coded decimal (BCD) format to the programmable counter 36. The fire control system 74 also provides a TTL positive pulse 78 indicating data transfer to trigger an "ENABLE DELAY" multivibrator 80, which generates a positive output pulse 82. The negative-going trailing edge of the output pulse 82 of the "ENABLE DELAY" multivibrator 80 triggers a "DATA" multivibrator 84.

The Q output signal 86 of the "DATA" multivibrator 84 is supplied to the other input 88 of the "OR" gate 60. When the "DATA" multivibrator 84 is triggered its Q output signal 86 goes positive, causing the output signal 62 of the "OR" gate 60 to go positive and turn on the oscillator switch 32. When the oscillator switch 32 turns on, it couples the 10 MHz oscillator signal 30 to the transmitter coil 10 to transmit data to the projectile 24.

The Q output signal 90 (complement of the Q output signal 86) of the "DATA" multivibrator 84 is supplied to an inverter 92, such as an RCA CD-4049 converter. The inverted output signal 94 from the inverter 92 is supplied to the $K_B$ input of the programmable counter 36 to switch this counter from the "preset" mode to the "count" mode. At this time the clock pulses 34 are counted by the programmable counter 36.

When the clock pulses counted reach the number 76 for the time of flight, the programmable counter 36 outputs a pulse 96. This pulse 96 triggers a "RESET" multivibrator 98. The output signal 100 of the "RESET" multivibrator 98 resets the output of the "DATA" multivibrator 84 to zero. This terminates the Q output signal 88 of the "DATA" multivibrator 84, which opens the oscillator switch 32 discontinuing the transmission of the 10 MHz signal 30 to the projectile 24. Thus, the number of 10 MHz cycles transmitted to the projectile 24 equals the time of flight number 76 entered into the programmable counter 36. The resetting of the "DATA" multivibrator 84 also switches the programmable counter 36 back to the "preset" mode so that the system is ready for the next round fired.

The delay introduced by the "ENABLE DELAY" multivibrator 80 is to assure the BCD time of flight data 76 is entered before the programmable counter 36 is permitted to start counting. This delay only needs to be several microseconds and simply means that the projectile receiver coil 26 passes the transmitter coil 10 a little further than necessary, but in no way affects the data transfer.

Commercially available devices may be used for any of the electronic elements in the sensor and data transmission system of FIG. 2. For example, RCA CD4098 dual monostable multivibrators may be used for the multivibrators 50, 54, 66, 70, 80, 84, and 98.

Figure 4:
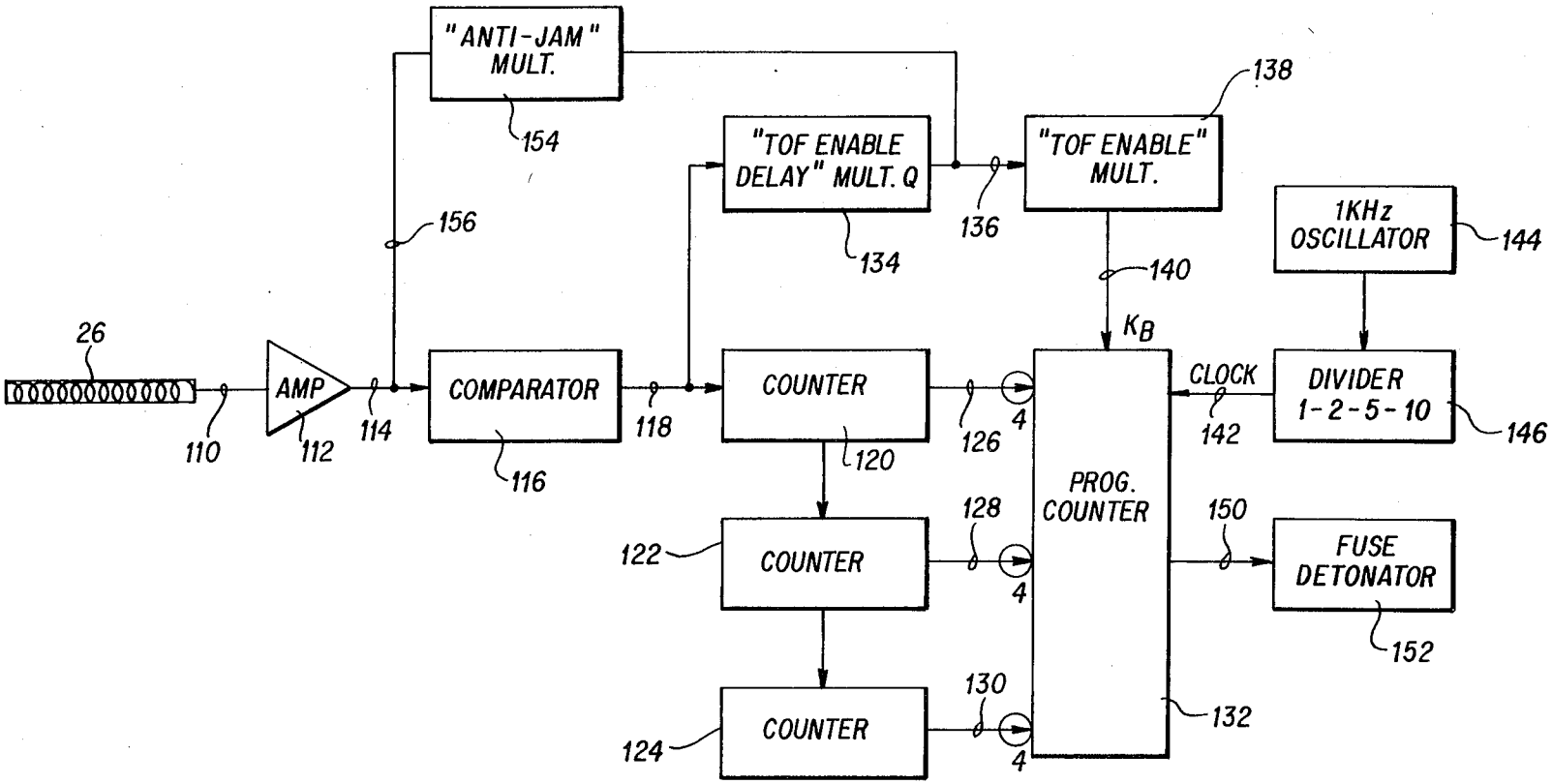
FIG. 4 is a block diagram of the RF receiver circuit in the projectile, according to the invention.
Figure 5:
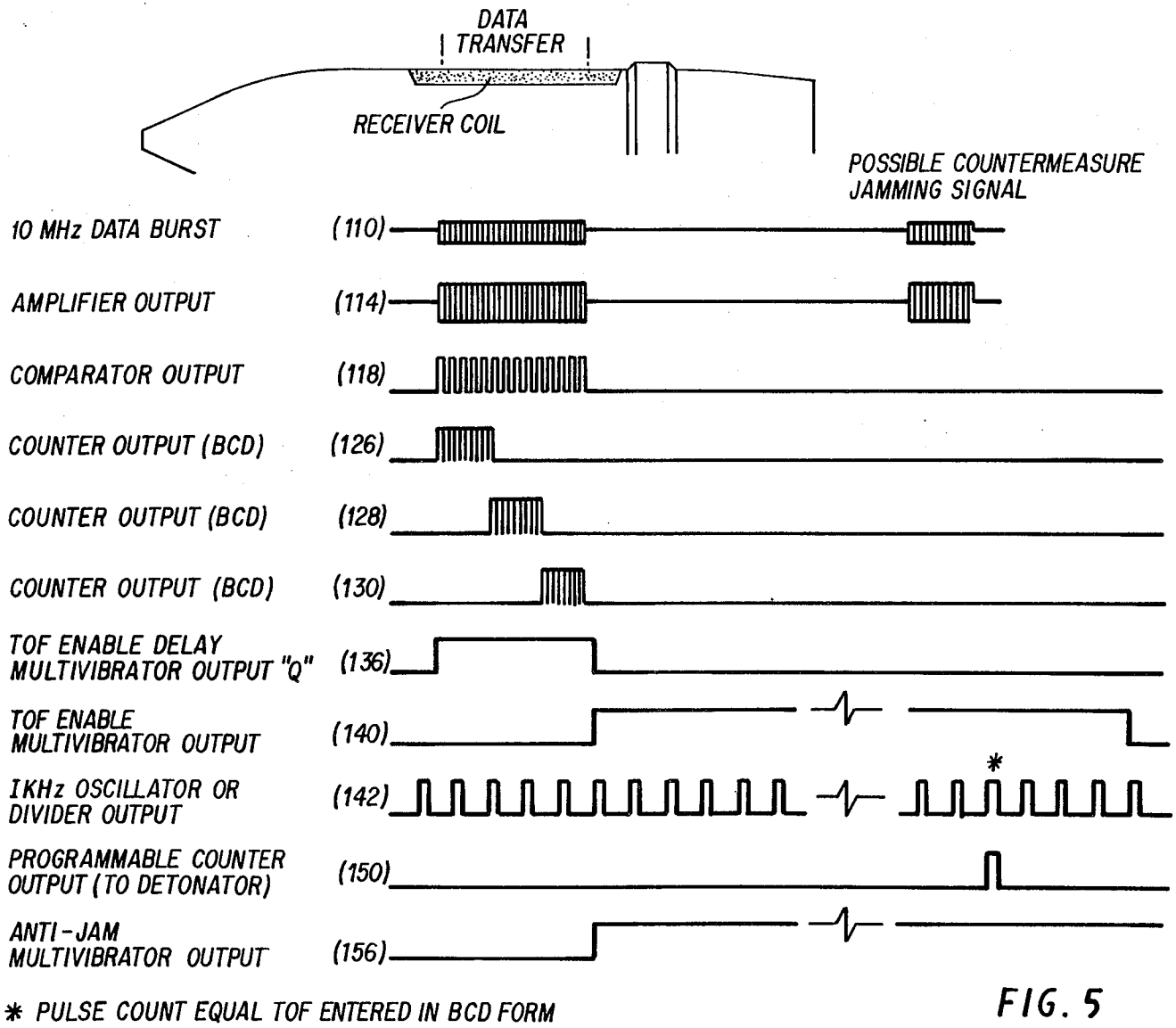
FIG. 5 is a plot of amplitude versus time for various signals in the RF receiver, during and after the exit of the projectile from the gun muzzle.

The block diagram of the timing circuit of the fuze in the projectile 24 is shown in FIG. 4, and the waveforms associated with this block diagram are shown in FIG. 5.

The 10 MHz data burst 110 is picked up by the receiver coil 26 as the projectile 24 passes through the transmitter coil 10. A 10 MHz amplifier 112, such as an Aventec GPD-202 or a Signetic NE-5205D, amplifies this signal 110. The amplifier output signal 114 is coupled into a voltage comparator 116, such as a Motorola MC-1710. The output of the comparator 116 is TTL level pulses 118 at a 10 MHz. rate. This burst of pulses 118 is coupled to a three decade (more if necessary) counter circuit 120, 122, and 124, which may be three RCA CD-4029 up/down counters. The output signals 126, 128, and 130 of the counters 120, 122, and 124, respectively, are coupled in BCD format into a programmable counter 132, such as an RCA CD-4059 counter, as the pulses are counted.

The output signal 118 of the comparator 116 also triggers a "(TOF) ENABLE DELAY" multivibrator 134. The "TOF ENABLE DELAY" multivibrator 134 is a re-triggable multivibrator having a pulse duration which is set to be 5 to 10 times the time duration (0.1 microseconds) of the 10 MHz comparator output signal 118. When triggered by the first pulse, the multivibrator 134 would normally time out after its timed condition of 0.5 to 1.0 microseconds; however, a succeeding 10 MHz pulse re-triggers the multivibrator 134 so that the pulse duration is equal to the time duration of the 10 MHz burst 118 plus the preset time of 0.5 to 1.0 microseconds.

The negative-going trailing edge of the output signal 136 of the "TOF ENABLE DELAY" multivibrator 134 triggers a "TOF ENABLE" multivibrator 138. The output signal 140 of the "TOF ENABLE" multivibrator 138 is fed to the $K_B$ input of the programmable counter 132, which switches the counter 132 from a "preset" mode to a "count" mode. The re-triggable multivibrator circuit 134 is used to assure that the TOF data in BCD form is entered in the programmable counter 132 before switching the counter to the "count" mode.

When switched to the "count" mode, the programmable counter 132 begins counting clock pulses 142 derived from a 1 KHz. oscillator 144, such as a Conner-Winfield S15R5, or the 1 KHz. pulse rate divided by a divider 146 such as an RCA CD-4029 up/down counter. The selection of the clock frequency is dependent on the maximum time of flight desired and the accuracy required, as is discussed below.

When the number of pulses counted by the programmable counter 132 equals the time of flight number entered in BCD form, the programmable counter 132 outputs a pulse 150 which is coupled to a fuze detonator circuit 152, which, in turn, detonates the explosive charge in the projectile warhead.

The negative-going edge of the output signal 136 of the "TOF ENABLE DELAY" multivibrator 134 is also used to trigger an "ANTI-JAM" multivibrator 154. The output signal 156 of this multivibrator 154 is fed back to the input of the voltage comparator 116 to disable it. Thereafter, if a countermeasure signal was being transmitted to "jam" the electronics of the fuze, the comparator 116 being disabled blocks entry of this jamming signal into the counter circuits 120, 122, 124.

RCA CD-4098 dual monostable multivibrators may be used for the multivibrators 134, 138, and 154.

To explain the operation of the invention described herein, consider a case where an intruder is not detected until the last moment and the time of flight of the projectile was calculated by the fire control 74 to be 0.520 seconds. The BCD number entered into the programmable counter 36 would be entered as 520. This would cause a burst of 520 cycles of the 10 MHz signal to be transmitted to the projectile. Thus the time duration of the data transfer would be 52 microseconds. The 520 cycles transferred to the projectile would be counted and entered as the number 520 in BCD form into the programmable counter 132 in the projectile. If the clock rate in the projectile was 1 KHz, the programmable counter 132 would then count 520 pulses with a time interval between pulses of one millisecond. Therefore, when 520 pulses were counted the delay before detonating the warhead would be 520 milliseconds, or 0.52 seconds.

The maximum time of the data transfer window depends upon the projectile velocity and the receiver coil length. This limits the maximum number of 10 MHz pulses which can be transmitted to the projectile and, therefore, the maximum delay.

Assuming a typical projectile velocity of 3000 ft/sec and the time of resolution of the delay to be ±1.0 millisecond, the accuracy could be ± three feet at a range of 3000 feet. This does not take into account total system errors caused by the electronics. However, for a typical small caliber projectile, for example, for a caliber of 40-mm, the total projectile length may be in the order of seven inches. On a projectile of this size, the receiver coil could be on the order of two and a half inches long. Allowing one quarter of an inch on each end of the receiver coil to account for position variation due to projectile velocity variation, the receiving coil would be in position for two inches of projectile travel. This limits the maximum communication window to 56 milliseconds or 560 pulses which results in a maximum time delay of 0.56 seconds when using a 1 KHz clock in the projectile. Normally, a longer maximum delay is required.

There are several methods which could be used to increase the maximum time of flight delay. For example, one method would be to raise the 10 MHz. oscillator frequency to 20 MHz. This would double the number of pulses transmitted to the projectile, resulting in a maximum of 1040 pulses being counted at a 1 KHz rate or a maximum time of flight of 1.040 seconds.

Another method would be to divide the 1 KHz clock frequency on the projectile by some factor, which could be done by the divider 146 in the circuit of FIG. 4. For example, dividing the 1 KHz by two would result in a time duration between the pulses counted of two milliseconds or a maximum time of flight of 1.040 seconds. To maintain coherence between the computed time of flight entered into the data transmission circuit and the fuze timing, the time of flight computed would be divided by two before entering it into the programmable counter 36.

Using a 10 MHz oscillator frequency and a 1 KHz clock frequency on the projectile, the following maximum delays and accuracy based on the clocks for a projectile as described would result:

| Maximum Time Delay | Divide by: | Resolution at 3000 feet (range) |
|---|---|---|
| 0.56 seconds | 1 | 3 ft. |
| 1.12 seconds | 2 | 6 ft. |
| 2.8 seconds | 5 | 15 ft. |
| 5.6 seconds | 10 | 30 ft. |

The examples given herein are general in nature and the choice of the oscillator frequency and the clock division ratio would depend upon this specific system desired, taking into account the projectile's size, velocity and practical target engagement range.

There are many variations, additions, and changes to the invention which would be obvious to one skilled in the art. For example, rather than automatically reactivating the transmitter coil 10 after the projectile has left the gun muzzle, the transmitter coil could be reactivated either manually or automatically at the time the next projectile was fired. Therefore, it is intended that the scope of the invention be limited only by the appended claims.

What is claimed and desired to be secured by Letters Patent of the United States is:

1. A method of setting a time delay value in an electronic fuze of a projectile exiting the muzzle of a gun barrel, wherein the time delay value is inductively transmitted in a form of an alternating oscillator signal, from a transmitter coil concentrically mounted to the gun barrel at the muzzle to a receiver coil disposed on the projectile and spaced from the front end of the projectile, during the time period that the receiver coil is inductively coupled to the transmitter coil, comprising the sequential steps of:

connecting the transmitter coil to an oscillator to receive and radiate a fixed frequency oscillator signal;

detecting a change in the transmitter coil impedance caused by the front end of the projectile passing through the transmitter coil;

disconnecting the transmitter coil from the oscillator;

after a first time interval of sufficient duration to allow the receiver coil to begin passing through the transmitter coil, reconnecting the transmitter coil to the oscillator for a second time interval having a duration directly proportional to the time delay value to be set in the fuze, then again disconnecting the transmitter coil from the oscillator, the proportion between the second time interval and the time delay value being selected such that the receiver coil is inductively coupled to the transmitter coil during the second time interval corresponding to a maximum time delay value to be set in the fuze; and processing the oscillator signal received by the receiving coil to set the time delay value in the fuze.

2. A method, as described in claim 1, which comprises the further step of reconnecting the transmitter coil to the oscillator after the projectile has passed completely through the transmitter coil.

3. A method, as described in claim 1, which comprises the further step of disabling the circuitry in the projectile for performing the signal processing step so that any later signal received by the receiver coil is not processed to set an erroneous time delay value in the fuze.

4. Apparatus for setting a time delay value in an electronic fuze of a projectile exiting the muzzle of a gun barrel, comprising:

a transmitter coil insulated from and concentrically mounted to the gun barrel in front of the muzzle;

an oscillator for generating an alternating oscillator signal at a given signal frequency;

an electrically-actuated oscillator switching means, having first and second control inputs, for connecting the transmitter coil to receive the oscillator signal whenever a switch closing signal is supplied to either the first or second control inputs, wherein a switch closing signal is normally supplied to the first control input and the transmitter coil radiates an electromagnetic field into the gun barrel which interacts with the projectile passing through the transmitter coil to cause a change in the impedance of the transmitter coil;

detector means for sensing the change in the transmitter coil impedance and generating a detector signal indicating that the projectile has started to pass through the transmitter coil;

first switch control means, actuated by the detector signal, for discontinuing the switch closing signal supplied to the first control input of the oscillator switching means, at least until the projectile completely passes through the transmitter coil, to open the oscillator switching means and disconnect the transmitter coil from the oscillator;

second switch control means, actuated by the detector signal, for supplying a switch closing signal to the second control input of the oscillator switching means after a first predetermined time interval for a second time interval proportional to the time delay value to be set in the fuze;

a receiver coil, which is insulated from and mounted to the projectile so that it is inductively coupled with the transmitter coil during a maximum second time interval corresponding to a maximum time delay value to be set in the fuze, for receiving the oscillator signal radiated by the transmitter coil during the second time interval, the receiver coil being spaced from the front end of the projectile so that it is not inductively coupled to the transmitter coil at the beginning of the first time interval; and signal processing means, disposed in the projectile, for processing the oscillator signal received by the receiver coil to set the time delay value in the fuze.

5. Apparatus, as described in claim 4, which further comprises circuit disabling means, disposed in the projectile, for disabling the signal processing means after the oscillator signal received by the receiver coil has been processes by the signal processing means to set the time delay value in the fuze.

6. Apparatus, as described in claim 4, wherein the first switch control means includes signal reactivating means for reactivating the switch closing signal supplied to the first control input of the oscillator switching means after the projectile has completely passed through the transmitter coil.

* * * * *